US007077202B2

(12) United States Patent
Shaw et al.

(10) Patent No.: US 7,077,202 B2
(45) Date of Patent: Jul. 18, 2006

(54) PROCESS FOR THE RECOVERY OF OIL FROM A NATURAL OIL RESERVOIR

(75) Inventors: Gareth David Huntley Shaw, Dana Bay (ZA); Roger Johansen, Stavanger (NO)

(73) Assignees: The Petroleum Oil and Gas Corporation of South Africa (Proprietary Limited), Mossel Bay (ZA); Statoil, ASA, Stavanger (ZA)

( * ) Notice: Subject to any disclaimer, the term of this patent is extended or adjusted under 35 U.S.C. 154(b) by 261 days.

(21) Appl. No.: 10/480,498

(22) PCT Filed: Jun. 12, 2002

(86) PCT No.: PCT/IB02/02159

§ 371 (c)(1),
(2), (4) Date: Mar. 15, 2004

(87) PCT Pub. No.: WO02/103157

PCT Pub. Date: Dec. 27, 2002

(65) Prior Publication Data

US 2004/0149438 A1 Aug. 5, 2004

(30) Foreign Application Priority Data

Jun. 15, 2001 (ZA) ..... 01/4939

(51) Int. Cl.
*E21B 43/16* (2006.01)

(52) U.S. Cl. ..... 166/268; 166/401

(58) Field of Classification Search ..... 166/401, 166/268, 272.1, 305.1
See application file for complete search history.

(56) References Cited

U.S. PATENT DOCUMENTS

| | | | | |
|---|---|---|---|---|
| 4,344,486 | A | 8/1982 | Parrish | |
| 4,434,613 | A | 3/1984 | Stahl | |
| 5,133,406 | A | 7/1992 | Puri | |
| 5,388,645 | A | 2/1995 | Puri et al. | |
| 5,566,755 | A * | 10/1996 | Seidle et al. | 166/263 |
| 6,494,262 | B1 * | 12/2002 | Chitty | 166/311 |
| 2004/0256116 | A1 * | 12/2004 | Olsvik et al. | 166/401 |

FOREIGN PATENT DOCUMENTS

| | | |
|---|---|---|
| EP | 0 162 368 | 11/1985 |
| GB | 2 117 053 | 10/1983 |

* cited by examiner

*Primary Examiner*—Frank S. Tsay
(74) *Attorney, Agent, or Firm*—Frommer Lawrence & Haug LLP; William S. Frommer

(57) ABSTRACT

A method for recovering oil (24) from a natural oil reservoir (18) includes the steps of separating air to produce an oxygen rich stream (40) and a nitrogen rich stream (34), providing a natural gas stream (12) and feeding at least part of the oxygen rich stream (40) and the natural gas stream (12) into a gas to liquid or GTL conversion installation (42) to produce hydrocarbon products (44) and heat. The heat produced in the gas to liquid conversion installation is used to produce energy (20) to pressurize (16) the nitrogen in the nitrogen rich stream (34) to produce a pressurized nitrogen rich stream (22). The pressurized nitrogen rich stream (22) is passed into a natural oil reservoir (18) to enhance the recovery of oil (24) from the reservoir.

22 Claims, 2 Drawing Sheets

PROCESS FOR THE RECOVERY OF OIL FROM A NATURAL OIL RESERVOIR

THIS INVENTION relates to the recovery of oil from a natural oil reservoir or oil well.

For the purposes of this specification a gas to liquid or GTL conversion installation is an installation which converts an oxygen stream and a natural gas stream into, primarily, hydrocarbon products and water and produces byproduct heat.

Crude oil is recovered from subterranean oil-bearing reservoirs by allowing the down hole pressure, which is naturally present in the reservoir, to force the liquid to the surface through wells drilled into the reservoir. However, when this pressure is insufficient to force the oil to the surface, enhanced oil recovery techniques are used to improve or maintain the oil production. The simplest of these techniques is to pump water into the reservoir through an injection system in order to maintain or increase the pressure in the oil field. In some cases water injection is not the most effective enhancement technique and pressure is preferably, maintained by using a gas under pressure.

Natural gas is extensively used for enhanced oil recovery. Examples of large oil fields which use natural gas injection are Fateh in Dubai, Fahud in Oman, Ekofisk off Norway, Hassi Messoud in Algeria and Hawkins and Yate in the USA. In these oil fields, the natural gas which is used is either that taken from the associated gas produced with the oil or it is natural gas which is piped from a natural gas field which is within a reasonable distance from the oil field. In most cases, energy is required for compression of the natural gas before it is injected into the subterranean oil field to enhance oil recovery.

Other gases which have been used foe enhanced oil recovery are nitrogen and carbon dioxide. The largest nitrogen injection is used in the Cantarell oil field off Mexico.

The major problem associated with enhanced oil recovery using either natural gas, nitrogen or carbon dioxide is finding an economical source of gas in sufficient volume. Current sources of gas include power plant flue gas, cement plant and limestone plant flue gas, the gas by-product of fertilizer and chemical plants, for example ammonia plants, naturally occurring gas deposits, and the like.

Gas to liquid (GTL) plants use large amounts of natural gas and large amounts of oxygen. The oxygen is produced in air separation plants which produce both oxygen and nitrogen. The nitrogen is not required for the gas to liquid process and is generally wasted. Accordingly a GTL plant generally generates large amounts of waste nitrogen. Gas to liquid plants also generate large amounts of excess heat or energy which, in remote locations, has no market and therefore no commercial value. On the other hand, when nitrogen is used for enhanced oil recovery, the nitrogen is usually produced in large cryogenic air separation plants which also produce oxygen. Such plants also consume large quantities of energy.

The invention provides a method whereby the GTL technology used for the conversion of gas to liquid fuels is extended to supplement the use of natural gas in enhanced recovery of crude oil. It provides a method whereby at least some of the natural gas used in the enhanced recovery of oil is diverted to the production of GTL fuels and byproduct nitrogen is used to replace the diverged natural gas. The invention goes further by using the excess energy (over and above that required for operating an air separation plant) which is produced in the gas to liquid fuel process, and which would otherwise go to waste in a remote location, for compressing the nitrogen for enhanced oil recovery.

The natural gas may either come from a separate source or from the natural oil reservoir being enhanced. If the natural gas is being sourced from the natural oil reservoir which is being enhanced, it may be necessary to separate nitrogen from the natural gas before feeding it to the GTL conversion installation. This nitrogen may be used or vented to atmosphere.

According to a first aspect of the invention, there is provided a method for recovering oil from a natural oil reservoir, the method including the steps of

- separating air to produce an oxygen rich stream and a nitrogen rich stream;
- providing a natural gas stream and feeding at least part of the oxygen rich stream and the natural gas stream into a gas to liquid or GTL conversion installation to produce hydrocarbon products and heat;
- using heat produced in the gas to liquid conversion installation to produce energy to pressurize the nitrogen in the nitrogen rich stream to produce a pressurized nitrogen rich stream; and
- passing the pressurized nitrogen rich stream into a natural oil reservoir to enhance the recovery of oil from the reservoir.

The energy will typically be electrical energy. Instead it may be in the form of high pressure steam.

The air may be separated to produce an oxygen rich stream containing about 0–25% nitrogen and a nitrogen rich stream containing about 0–5% oxygen. Preferably; the air will be separated to produce an oxygen rich stream containing about 0.5% nitrogen and a nitrogen rich stream containing less than about 10 ppm of oxygen for pressurisation of the oil reservoir.

The natural gas may be obtained from a separate source such as a natural gas field or a gas pipeline. Instead, or in addition, the natural gas may be obtained from the natural oil reservoir from which oil recovery is being enhanced. If the natural gas is sourced from the natural oil reservoir, the nitrogen may be separated from the natural gas before feeding the natural gas into the gas to liquid conversion installation. The separated nitrogen may be used or vented to atmosphere.

According to another aspect of the invention, there is provided a method of modifying an enhanced oil recovery process of the type in which a natural gas is fed into a natural oil reservoir to enhance oil recovery, the method including

- diverting at least part of the natural gas to a gas to a liquid (GTL) conversion installation which is linked to an air separation plant which produces an oxygen rich stream and a nitrogen rich stream;
- feeding the oxygen rich stream into the gas to liquid conversion installation; and
- passing or injecting at least part of the nitrogen rich stream into the oil reservoir to replace the natural gas which has been diverted.

The method may include using at least some of the heat produced in the gas to liquid installation to generate energy to raise the pressure of the nitrogen rich stream.

The method has the advantage that, although part of the natural gas stream is diverted, the volume of the nitrogen produced by the air separator is greater than the volume of the natural gas diverted so that a larger volume of gas is available for enhanced oil recovery. This results in maintaining or increasing the oil recovery from the reservoir.

According to another aspect of the invention, there is provided a method of modifying an enhanced oil recovery installation of the type in which a natural gas is fed into a natural oil reservoir, and which includes at least one natural gas feed line for feeding the natural gas into the reservoir, the method including providing a gas to liquid (GTL) conversion installation and an air separation plant capable of producing an oxygen rich stream and a nitrogen rich stream, the air separation plant having an oxygen outlet and a nitrogen outlet, and linking the oxygen outlet to the gas to liquid conversion installation so that oxygen can be fed into the gas to liquid conversion installation;

linking the natural gas feed line to the gas to liquid conversion installation with a gas flow line so that at least part of the natural gas can be diverted to the gas to liquid conversion installation;

providing a nitrogen pressurization installation and linking it to the nitrogen outlet of the air separation plant so that nitrogen can flow to the pressurization installation to be pressurized; and providing a flow line to extend from the pressurization installation to the natural oil reservoir so that pressurized nitrogen can flow to the oil reservoir.

The method may include providing an energy converter and linking it to the nitrogen pressurization installation and the gas to liquid conversion installation so that heat generated in the gas to liquid conversion installation can be converted to energy for the pressurization installation.

The energy converter may be a waste heat boiler. The boiler will generate high pressure steam which may be used to drive a steam turbine coupled to an electric power generator or to air compressors in the air separation plant.

The enhanced oil recovery installation may include a natural gas pressurizing installation, and the method may include using the natural gas pressurizing installation to pressurize the nitrogen. The method may thus include the prior modification of the natural gas pressurizing installation.

According to another aspect of the invention, there is provided a method of modifying an enhanced oil recovery installation of the type in which a natural gas is fed into a natural oil reservoir, and which includes at least one natural gas feed line and a natural gas pressurization installation for feeding the natural gas into the reservoir, the method including providing a gas to liquid (GTL) conversion installation and an air separation plant capable of producing an oxygen rich stream and a nitrogen rich stream, the air separation plant having an oxygen outlet and a nitrogen outlet, and linking the oxygen outlet to the gas to liquid conversion installation so that oxygen can be fed into the gas to liquid conversion installation;

linking the natural gas feed line to the gas to liquid conversion installation with a gas flow line so that at least part of the natural gas can be diverted to the gas to liquid conversion installation;

linking the natural gas pressurization installation to the nitrogen outlet of the air separation plant so that nitrogen can flow to the pressurization installation to be pressurized; and providing a flow line to extend from the nitrogen pressurization installation to the natural oil reservoir so that pressurized nitrogen can flow to the oil reservoir.

The natural gas pressurization installation may comprise natural gas compressors and the method may include modifying the natural gas compressors for nitrogen service.

The method may include providing an energy converter and linking it to the nitrogen pressurization installation and the gas to liquid conversion installation so that heat generated in the gas to liquid conversion installation can be converted to energy for the pressurization installation.

The energy converter may be a waste heat boiler. The boiler will generate high pressure steam which may be used to drive a steam turbine coupled to an electric power generator or to air compressors in the air separation plant.

According to another aspect of the invention, in a method of recovering oil from a natural oil reservoir in which pressurized nitrogen is pumped into the natural oil reservoir to enhance recovery of oil from the reservoir, the nitrogen being produced in an air separation plant which produces a waste oxygen stream having a purity of 70–100% and a high purity nitrogen stream, there is provided the improvement of providing a natural gas stream and feeding the natural gas stream together with the waste oxygen stream into a gas to liquid conversion installation to produce hydrocarbon products and heat; and using at least some of the heat produced in the gas to liquid installation to generate energy to pressurize the nitrogen stream.

The natural gas stream may be obtained from the reservoir.

The oxygen stream may have a purity of 90–100%.

According to another aspect of the invention, there is provided an installation for the production of gas to liquid (GTL) products and enhanced oil recovery from a natural oil reservoir, the installation including a pressurizing installation for raising the pressure of nitrogen for the enhanced recovery of oil;

an air separation plant capable of producing nitrogen having an oxygen content of less than 10 ppm;

a gas to liquid conversion plant;

flow lines arranged to feed natural gas to the gas to liquid conversion plant and nitrogen from the air separation plant to the pressurizing installation; and a waste heat converter arranged to convert waste heat produced in the gas to liquid conversion plant into energy and which is operably linked to the pressurizing installation to provide energy for driving the pressurizing installation.

The waste heat conversion means will typically include a waste heat boiler which generates high pressure steam which drives a steam turbine coupled to an electric power generator or to the air compressors in the air separation plant.

According to another aspect of the invention, there is provided a modified installation for the production of gas to liquid (GTL) products and enhanced oil recovery from a natural oil reservoir, the installation including a pressurizing installation;

an air separation plant capable of producing nitrogen having an oxygen content of less than 10 ppm;

a gas to liquid conversion plant;

flow lines and control valves arranged to divert at least some natural gas from a natural gas enhanced oil recovery service to the gas to liquid conversion plant and nitrogen from the air separation plant to the pressurizing installation; and a waste heat converter arranged to convert waste heat produced in the gas to liquid conversion plant into energy and which is operably linked to the pressurizing installation to provide energy for driving the pressurizing installation.

The waste heat conversion means will typically include a waste heat boiler which generates high pressure steam which drives a steam turbine coupled to an electric power generator or to the air compressors in the air separation plant.

Such an installation would thus be a modification of a pre-existing installation in which natural gas is used for enhanced oil recovery. At least part of the natural gas would be diverted to the GTL installation and the resulting nitrogen would be used for enhanced oil recovery.

According to another aspect of the invention, in a process in which pressurized natural gas is used for the enhanced recovery of oil, there is provided a method of replacing at least some of the natural gas with nitrogen such that the volume of the nitrogen is 1.5 to 2.5 times greater than that of the natural gas which it replaces, the method including diverting at least part of the natural gas to a gas to liquid (GTL) conversion installation which is linked to an air separation plant which produces an oxygen rich stream and a nitrogen rich stream;

feeding the oxygen rich stream into the gas to liquid conversion installation; and passing at least part of the nitrogen rich stream into the oil reservoir to replace the natural gas which has been diverted.

According to another aspect of the invention, in a process in which pressurized natural gas is passed into a natural oil reservoir for the enhanced recovery of oil, there is provided a method of reducing the volume of natural gas required for the enhanced oil recovery by between about 20% and 60%, the method including diverting at least part of the natural gas to a gas to liquid (GTL) conversion installation which is linked to an air separation plant which produces an oxygen rich stream and a nitrogen rich stream; and passing at least part of the nitrogen rich stream into the oil reservoir to replace the natural gas which has been diverted.

The invention thus provides a method for the enhanced recovery of crude oil from subterranean oil reservoirs and more particularly, to the use of technology for the conversion of gas to liquid fuels (GTL) to improve the use of natural gas for the enhanced recovery of crude oil. The invention discloses a method whereby natural gas, which is intended for enhanced oil recovery, is diverted to liquid fuel production and a gas to liquid plant is operated to produce high pressure relatively pure nitrogen for use in enhanced oil recovery. The invention also provides a method of using the excess energy which is produced in the gas to liquid fuel process, and which would otherwise go to waste in a remote location, for compressing the nitrogen for enhanced oil recovery and for operating an air separation plant. The invention thus links a gas to liquid process and an enhanced oil recovery process in a synergistic fashion.

The oxygen requirement of a gas to liquid fuel production plant using natural gas, is well known to those familiar in the art. The oxygen is used as an oxidant in a methane reforming process to raise the temperature of the natural gas and steam mixture for the production of synthesis gas. The synthesis gas is used to manufacture synthetic hydrocarbon liquids and waxes in a Fisher Tropsch reaction process of the type described in U.S. Pat. No. 5,520,890. The synthetic products are converted into liquid motor vehicle fuels in a subsequent hydrocracking process. Separating the oxygen required for the gas to liquid process from air, produces nitrogen as a by-product. The volume of nitrogen produced is about 2.34 times the volume of natural gas used. Therefore, diverting natural gas to a gas to liquid plant and using the nitrogen produced in the separation process, effectively increases the volume of gas available for enhanced oil recovery and, at the same time, generates surplus energy for compression of the nitrogen.

Accordingly, by supplying natural gas to a gas to liquid plant and using the waste nitrogen for enhanced oil recovery, either the overall natural gas requirement for enhanced oil recovery will be reduced to approximately 43% of what it was before, or the gas available for enhanced oil recovery will be increased by approximately 234%. By trading the nitrogen and natural gas volume, the nett effect will be that the gas to liquid plant will have negative natural gas feedstock costs. The economics of a conventional stand alone gas to liquid plant have generally precluded their application to add value to natural gas, even where remote locations reduce feedstock natural gas costs to production costs of $0.50 per Giga joule (or million BTU). A negative feedstock cost for a gas to liquid plant will significantly improve the economic viability of gas to liquid technology while supporting enhanced oil recovery.

The invention is now described, by way of example, with reference to the accompanying diagrammatic drawings, in which.

Figure 1:
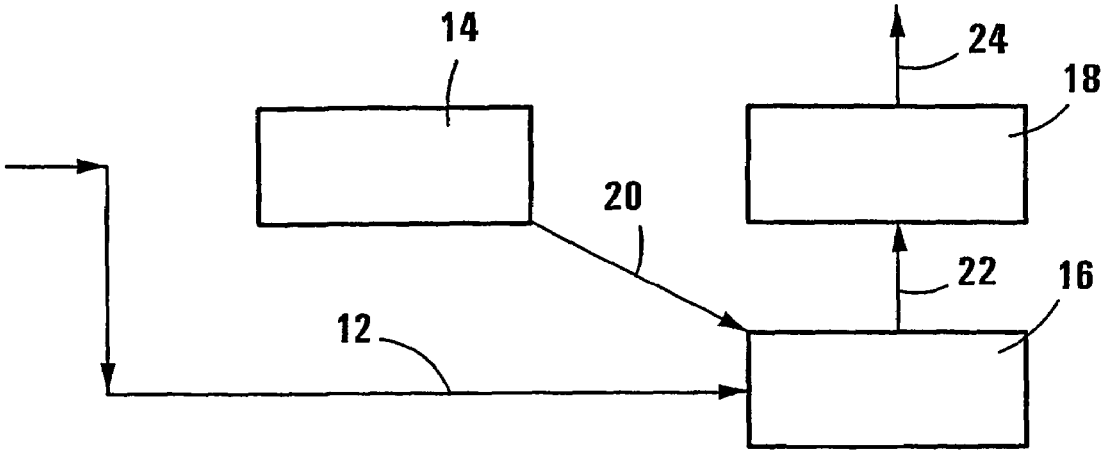
FIG. 1 is a schematic diagram of a process for the enhanced recovery of oil using natural gas.

Referring to the drawings, FIG. 1 depicts a process for the enhanced recovery of oil using compressed natural gas. The diagram schematically shows a natural gas flow line 12, a power plant 14, a compressor 16 and an oil field 18. The power plant 14 provides energy to the compressor 16, as shown schematically by the arrow 20, and natural gas is fed to the compressor 16 via the flow line 12. The compressed natural gas is then piped via a flow line 22 from the compressor 16 to the oil field 18 where it is used to enhance the production of crude oil in the oil field 18, as shown schematically by the arrow 24.

The natural gas is compressed to 105 bar abs (1525 psia) in the compressor 16 before it is piped to the oil field 18. The power plant 14 is a gas driven plant which uses 37.8 million standard cubic meters per day (1336 MMscfd) of natural gas and consumes 394 megawatt (528 000 hp) of electrical power to drive the compressor 16.

Over a fifteen year project life, this operation is estimated to produce compressed natural gas at approximately $70 per 1000 cubic meters ($2 per Mscf) and to cost approximately $13 billion in total. It may be possible to source natural gas from the oil field 18 once the enhanced production is completed. This benefit could be used to reduce the overall cost.

Figure 2:
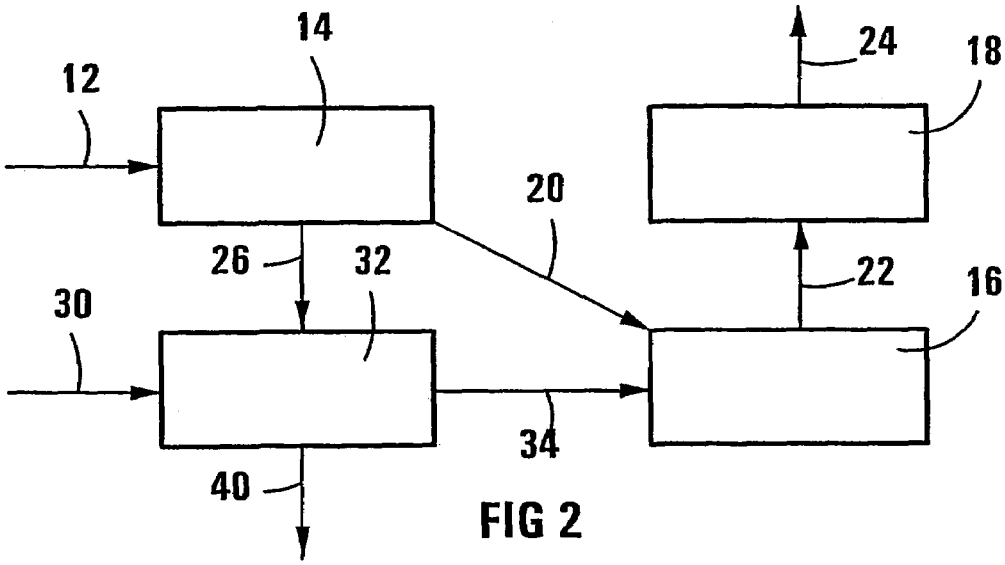
FIG. 2 is a schematic diagram of a process for the enhanced recovery of oil using nitrogen.

FIG. 2 depicts a process for the enhanced recovery of oil using compressed nitrogen, and the same numbers have been used to indicate the same or similar features of the processes of FIGS. 2 and 1.

The process of FIG. 2 differs from that of FIG. 1 in that compressed nitrogen rather than compressed natural gas is used in the enhanced oil recovery process. The process of FIG. 2 also differs from that of FIG. 1 in that the natural gas flow line 12 feeds natural gas to the power plant 14 to produce power for the compressor 16 and an air feedline 30 feeds air into an air separation plant 32 which produces nitrogen which is fed via a feedline 34 to the compressor 16. The nitrogen is compressed to a pressure of 105 bar abs (1525 psia). A waste oxygen stream 40 is vented to atmosphere.

The energy for the air separation plant 32 is also provided by the power plant 14, as shown schematically by the arrow 26. The volume of nitrogen required is 34 million standard cubic meters per day (1200 MMscfd) and 343 megawatt (500 500 hp) of electrical power is required to drive the compressor 16 and the air separation plant 32.

Over a fifteen year project life, this operation is estimated to produce compressed nitrogen at approximately $18 per 1000 cubic meters ($0.5 per Mscf) and to cost approximately $3 billion in total.

Figure 3:
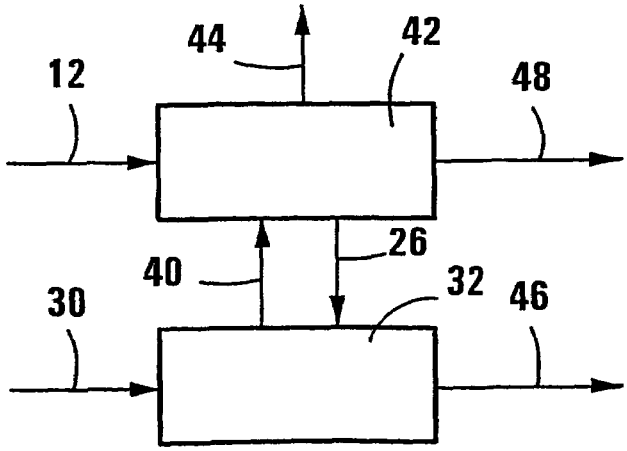
FIG. 3 is a schematic diagram of a gas to liquid process.

FIG. 3 depicts a conventional gas to liquid conversion installation. Again, the same numbers have been used to indicate the same or similar features of the processes depicted in FIGS. 1, 2 and 3.

In the gas to liquid process depicted in FIG. 3, oxygen is fed from the air separation plant 32 via the feedline 40 to a gas to liquid conversion plant 42. The natural gas is now fed into the gas to liquid plant 42 via the flow line 12 at a rate of 14.8 million standard cubic meters per day (523 MMscfd). The oxygen and the natural gas are converted into a liquid fuel stream of 9500 cubic meters per day (60 000 bpd) as shown schematically by the arrow 44.

The air separation plant 32 produces a waste nitrogen gas stream 46 of 35 million standard cubic meters per day (1234 MMscfd) and the gas to liquid plant 42 produces excess energy as shown schematically by the arrow 48. The nitrogen stream 46 is vented to atmosphere. The power requirement of approximately 200 megawatt (268 000 hp) to drive, the air separator 32 is provided as steam by the gas to liquid plant 42 as shown schematically by the arrow 26. The excess power stream 48 of approximately 270 megawatt (362 000 hp) does not have a commercial value in remote locations.

Over a fifteen year project life, this operation is estimated to produce diesel and naphtha products that will break even or do slightly better at oil prices of $15–$20 per barrel.

Figure 4:
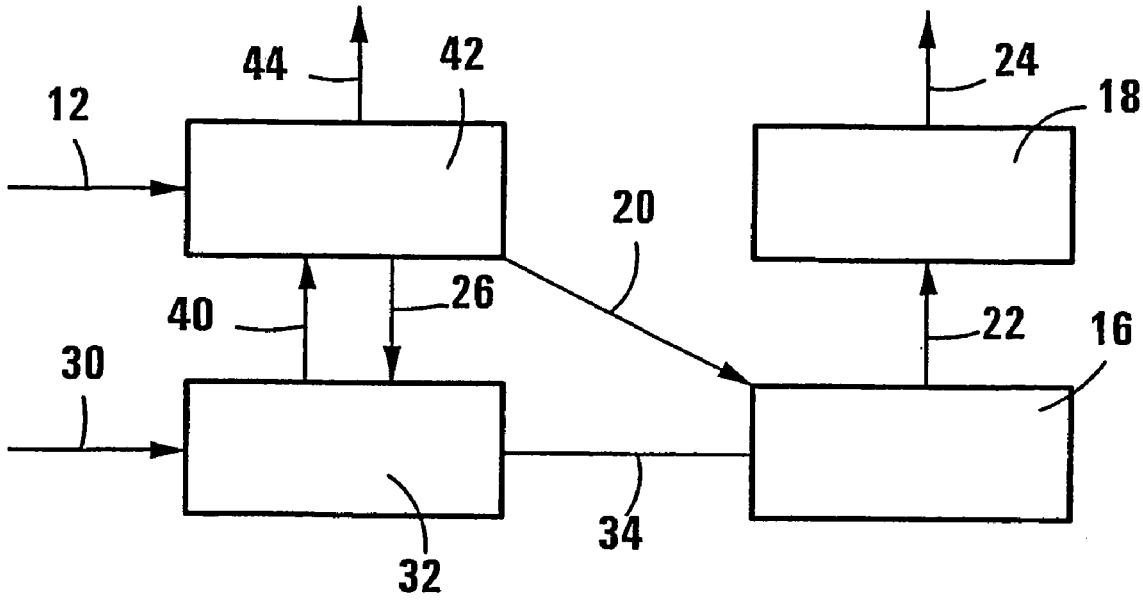
FIG. 4 is a schematic diagram of the process of the invention.

FIG. 4 shows the process of the invention and again the same numbers have been used to indicate the same or similar features of the processes shown in FIGS. 1, 2, 3 and 4.

In the process depicted in FIG. 4, the nitrogen stream 34 which, in this embodiment is 34 million standard cubic meters per day (1200 MMscfd), is fed to the compressor 16 and power (as shown schematically by the arrow 20) is provided by the gas to liquid plant 42 to drive the compressor 16 to produce compressed nitrogen which is piped via the flow line 22 to the oil field 18 for enhanced oil recovery. Power is again provided to the air separation plant by the gas to liquid installation as shown by the arrow 26.

The air separation plant 32 provides the requirement of 34 million standard cubic meters per day (1200 MMscfd) of nitrogen for enhanced oil recovery and the gas to liquid plant provides the approximately 200 megawatt (268 000 hp) required to drive the air separation plant 32.

As a result, the total normal power requirement of 373 megawatt (500 500 hp) which is required to compress nitrogen to 105 bar abs (1515 psia) is reduced to 175 megawatt (234 500 hp) because the energy used to operate the air separation plant 32 is provided by the gas to liquid plant 42. The excess energy produced in the gas to liquid plant provides 270 megawatt (362 000 hp) for the compressor 16. The process of the invention accordingly requires only 14.8 million standard cubic meters per day (523 MMscfd) of natural gas, which is 39% of the amount of natural gas used in the process shown in FIG. 1.

In a non-limiting example of the process of the invention, natural gas (about 490 tons per hour) is fed into a 9500 cubic meters per day (60 000 barrels per day) gas to liquid plant. Air (about 2540 tons per hour) is fed into an air separation plant which produces 558 tons of oxygen per hour and 1978 tons of nitrogen per hour. Oxygen (about 558 tons per hour) is fed into the gas to liquid plant to produce a syngas. The syngas is fed into a Fisher Tropsch unit and a downstream hydrocracker to produce about 9500 cubic meters per day (60 000 barrels) of diesel and naphtha per day (about 237 and about 66 tons per hour respectively). Nitrogen (about 1978 tons per hour) is compressed in the compressor and pumped to the oil field for enhanced oil recovery.

As will be evident to a person skilled in the art of nitrogen-enhanced oil recovery, the supply of nitrogen in the volume described above, can increase recoverable reserves by 2–3 billion barrels. At a nominal $15 per barrel this amounts to a total increased crude oil production value of approximately $40 billion. A 9500 cubic meters per day (60 000 barrels) per day gas to liquid plant would cost about $2 billion. Additional capital costs associated with injection of the nitrogen will largely depend on the distance between the gas to liquid plant and the oil field but could typically add another $0.5 billion–$1.0 billion to the total capital costs. At $15 per barrel oil price the GTL plant could break even, leaving the costs of the pipeline to come out of the increased crude oil production of $40 billion.

Where the enhanced oil production is already underway using natural gas the gas to liquid plant will deliver about 1978 tons per hour of nitrogen to the oil field and will purchase about 490 tons per hour of natural gas. In volume terms the gas to liquid plant will deliver about 1 456 000 normal cubic meters per hour of nitrogen to the oil field and purchase about, 618 000 normal cubic meters per hour of natural gas. If it is assumed that the oil field operator and the gas to liquid operator both pay the same natural gas price (in volume terms) for the nitrogen and natural gas, the gas to liquid operator will achieve a negative feedstock cost of:

$$\frac{(1\ 456\ 000 - 618\ 000)}{618\ 000} \times \text{gas price} = 1.36 \times \text{gas price}$$

A typical remote natural gas prices of about $0.5 per gigajoule, the feedstock costs of a gas to liquid plant are about $5 per barrel of final product. By selling the nitrogen at the same remote natural gas price in volume terms, the gas to liquid plant will result in a credit of about $7 per barrel of gas to liquid product. A GTL project therefore that would normally achieve a breakeven position at $15 per barrel would increase its profits by approximately $2 billion over a 15 year project life.

In summary the invention discloses a process which exploits hitherto untapped synergy where natural gas can or is being used to enhance the recovery of oil from subterranean oil reservoirs. Rather than using the natural gas for enhanced oil recovery, the natural gas is processed in a gas to liquids (GTL) plant to produce hydrocarbon liquid fuels. The GTL plant uses pure oxygen in the production of liquid hydrocarbon fuels. Pure oxygen is produced in an air separation plant which also produces substantially pure nitrogen. The GTL plant also produces excess power. The excess power is used to compress the nitrogen, thereby replacing the natural gas, for use in enhanced oil recovery.

The invention has application wherever natural gas is available for enhanced oil recovery from a subterranean oil reservoir and where pressurization of the oil reservoir is required by gas injection into the gas cap of the reservoir. The invention shows how three different independent technologies can be combined and shows the synergy produced when they are combined.

The invention claimed is:

1. A method for recovering oil from a natural oil reservoir, the method including the steps of separating air to produce an oxygen rich stream and a nitrogen rich stream;

providing a natural gas stream and feeding at least part of the oxygen rich stream and the natural gas stream into a gas to liquid or GTL conversion installation to produce hydrocarbon products and heat;

using heat produced in the gas to liquid conversion installation to produce energy to pressurize the nitrogen in the nitrogen rich stream to produce a pressurized nitrogen rich stream; and passing the pressurized nitrogen rich stream into a natural oil reservoir to enhance the recovery of oil from the reservoir.

2. A method as claimed in claim 1, in which the energy is in a form selected from electrical energy and high pressure steam.

3. A method as claimed in claim 1, in which the air is separated to produce an oxygen rich stream containing about 0–25% nitrogen and a nitrogen rich stream containing about 0–5% oxygen.

4. A method as claimed in claim 3, in which the nitrogen rich stream contains less than about 10 ppm of oxygen.

5. A method for recovering oil from a natural oil reservoir as claimed in claim 1, in which the natural gas is obtained from the natural oil reservoir from which oil recovery is being enhanced.

6. A method for recovering oil from a natural oil reservoir as claimed in claim 5, in which nitrogen is separated from the natural gas before feeding the natural gas into the gas to liquid conversion installation.

7. A method of modifying an enhanced oil recovery process of the type in which a natural gas is fed into a natural oil reservoir to enhance oil recovery the method including diverting at least part of the natural gas to a gas to a liquid (GTL) conversion installation which is linked to an air separation plant which produces an oxygen rich stream and a nitrogen rich stream;

feeding the oxygen rich steam into the gas to liquid conversion installation; and passing at least part of the nitrogen rich stream into the oil reservoir to replace the natural gas which has been diverted.

8. A method as claimed in claim 7 which includes using at least some of the heat produced in the gas to liquid installation to generate energy to raise the pressure of the nitrogen rich stream.

9. A method of modifying an enhanced oil recovery installation of the type in which a natural gas is fed into a natural oil reservoir, and which includes at least one natural gas feed line for feeding the natural gas into the reservoir, the method including providing a gas to liquid (GTL) conversion installation and an air separation plant capable of producing an oxygen rich stream and a nitrogen rich stream, the air separation plant having an oxygen outlet and a nitrogen outlet, and linking the oxygen outlet to the gas to liquid conversion installation so that oxygen can be fed into the gas to liquid conversion installation;

linking the natural gas feed line to the gas to liquid conversion installation with a gas flow line so that at least part of the natural gas can be diverted to the gas to liquid conversion installation;

providing a nitrogen pressurization installation and linking it to the nitrogen outlet of the air separation plant so that nitrogen can flow to the pressurization installation to be pressurized; and providing a flow line to extend from the nitrogen pressurization installation to the natural oil reservoir so that pressurized nitrogen can flow to the oil reservoir.

10. A method as claimed in claim 9 which includes providing an energy converter and linking it to the nitrogen pressurization installation and the gas to liquid conversion installation so that heat generated in the gas to liquid conversion installation can be converted to energy for the pressurization installation.

11. A method of modifying an enhanced oil recovery installation of the type in which a natural gas is fed into a natural oil reservoir, and which includes at least one natural gas feed line and a natural gas pressurization installation for feeding the natural gas into the reservoir, the method including providing a gas to liquid (GTL) conversion installation and an air separation plant capable of producing an oxygen rich stream and a nitrogen rich stream, the air separation plant having an oxygen outlet and a nitrogen outlet, and linking the oxygen outlet to the gas to liquid conversion installation so that oxygen can be fed into the gas to liquid conversion installation;

linking the natural gas feed line to the gas to liquid conversion installation with a gas flow line so that at least part of the natural gas can be diverted to the gas to liquid conversion installation;

linking the natural gas pressurization installation to the nitrogen outlet of the air separation plant so that nitrogen can flow to the pressurization installation to be pressurized; and providing a flow line to extend from the nitrogen pressurization installation to the natural oil reservoir so that pressurized nitrogen can flow to the oil reservoir.

12. A method as claimed in claim 11, in which the pressurizing installation comprises at least one natural gas compressor and in which the method includes modifying the compressor for nitrogen service.

13. A method as claimed in claim 11 which includes providing an energy converter and linking it to the nitrogen pressurization installation and the gas to liquid conversion installation so that heat generated in the gas to liquid conversion installation can be converted to energy for the pressurization installation.

14. An installation as claimed in claim 13, in which the waste heat converter is a waste heat boiler which generates high pressure steam.

15. In a method of recovering oil from a natural oil reservoir in which pressurized nitrogen is pumped into the natural oil reservoir to enhance recovery of oil from the reservoir, the nitrogen being produced in an air separation plant which produces a waste oxygen stream having a purity of 70–100% and a high purity nitrogen stream, there is provided the improvement of providing a natural gas stream and feeding the natural gas stream together with the waste oxygen stream into a gas to liquid conversion installation to produce hydrocarbon products and heat; and using at least some of the heat produced in the gas to liquid installation to generate energy to pressurize the nitrogen stream.

16. A method as claimed in claim 15, in which the waste oxygen stream has a purity of 90–100%.

17. An installation for the production of gas to liquid (GTL) products and enhanced oil recovery from a natural oil reservoir, the installation including a pressurizing installation for raising the pressure of nitrogen for the enhanced recovery of oil;

an air separation plant capable of producing nitrogen having an oxygen content of less than 10 ppm;

a gas to liquid conversion plant;

flow lines arranged to feed natural gas to the gas to liquid conversion plant and nitrogen from the air separation plant to the pressurizing installation; and a waste heat converter arranged to convert waste heat produced in the gas to liquid conversion plant into energy and which is operably linked to the pressurizing installation to provide energy for driving the pressurizing installation.

18. A modified installation for the production of gas to liquid (GTL) products and enhanced oil recovery from a natural oil reservoir, the installation including pressurizing installation;

an air separation plant capable of producing nitrogen having an oxygen content of less than 10 ppm;

a gas to liquid conversion plant;

flow lines and control valves arranged to divert at least some natural gas from a natural gas enhanced oil recovery service to the gas to liquid conversion plant and nitrogen from the air separation plant to the pressurizing installation; and a waste heat converter arranged to convert waste heat produced in the gas to liquid conversion plant into energy and which is operably linked to the pressurizing installation to provide energy for driving the pressurizing installation.

19. In a process in which pressurized natural gas is used for the enhanced recovery of oil, there is provided a method of replacing at least some of the natural gas with nitrogen such that the volume of the nitrogen is 1.5 to 2.5 times greater than that of the natural gas which it replaces, the method including diverting at least part of the natural gas to a gas to liquid (GTL) conversion installation which is linked to an air separation plant which produces an oxygen rich stream and a nitrogen rich stream;

feeding the oxygen rich stream into the gas to liquid conversion installation; and passing at least part of the nitrogen rich stream into the oil reservoir to replace the natural gas which has been diverted.

20. A method as claimed in claim 19, which includes using at least some of the heat produced in the gas to liquid installation to generate energy to raise the pressure of the nitrogen rich stream.

21. In a process in which pressurized natural gas is passed into a natural oil reservoir for the enhanced recovery of oil, there is provided a method of reducing the volume of natural gas required for the enhanced oil recovery by between about 20% and 60%, the method including diverting at least part of the natural gas to liquid (GTL) conversion installation which is linked to an air separation plant which produces an oxygen rich stream and a nitrogen rich stream; and passing at least part of the nitrogen rich stream into the oil reservoir to replace the natural gas which has been diverted.

22. A method as claimed in claim 21, which includes using at least some of the heat produced in the gas to liquid installation to generate energy to raise the pressure of the nitrogen rich stream.

* * * * *

UNITED STATES PATENT AND TRADEMARK OFFICE

CERTIFICATE OF CORRECTION

PATENT NO. : 7,077,202 B2
APPLICATION NO. : 10/480498
DATED : July 18, 2006
INVENTOR(S) : Gareth David Huntley Shaw et al.

It is certified that error appears in the above-identified patent and that said Letters Patent is hereby corrected as shown below:

Col. 9, line 42 (Claim 7) - change “steam” to --stream--.

Signed and Sealed this

Twelfth Day of September, 2006

JON W. DUDAS
*Director of the United States Patent and Trademark Office*